United States Patent [19]

Quigley

[11] Patent Number: 4,771,814

[45] Date of Patent: Sep. 20, 1988

[54] SEAM FOR MULTILAYER PAPERMAKING FABRIC AND METHOD OF MAKING SAME

[75] Inventor: Scott D. Quigley, Starkville, Miss.

[73] Assignee: Niagara Lockport Industries, Inc., Quincy, Fla.

[21] Appl. No.: 37,612

[22] Filed: Apr. 13, 1987

[51] Int. Cl.[4] ..... D21F 1/12; D21F 7/10; D06H 5/00

[52] U.S. Cl. ..... 139/383 A; 28/141; 162/348; 162/DIG. 1

[58] Field of Search ..... 162/348, DIG. 1; 139/383 A, 383 AA, 408–413, 425 A; 245/10; 28/142, 141

[56] References Cited

U.S. PATENT DOCUMENTS 3,335,986 8/1967 Cross ..... 139/383 AA
3,596,858 8/1971 Curtis ..... 245/10
3,784,133 1/1974 Hill, Jr. et al. ..... 245/10
4,083,090 4/1978 Duvekot ..... 28/104

FOREIGN PATENT DOCUMENTS 1159293 12/1983 Canada ..... 162/348

*Primary Examiner*—David L. Lacey
*Assistant Examiner*—K. M. Hastings
*Attorney, Agent, or Firm*—Pettis & McDonald

[57] ABSTRACT

A technique of forming a seam in a woven multilayer papermaking fabric provides a machine side join for the ends of each machine direction filament with a machine side knuckle formed in such machine direction filament and spaced from the closest exit point of the machine direction filament tails from the fabric by not less than one nor more than three intervening cross machine filaments, with the weave crossings in both the machine direction and cross machine direction in the join being substantially the same as the weave crossings in the body of the fabric.

16 Claims, 3 Drawing Sheets

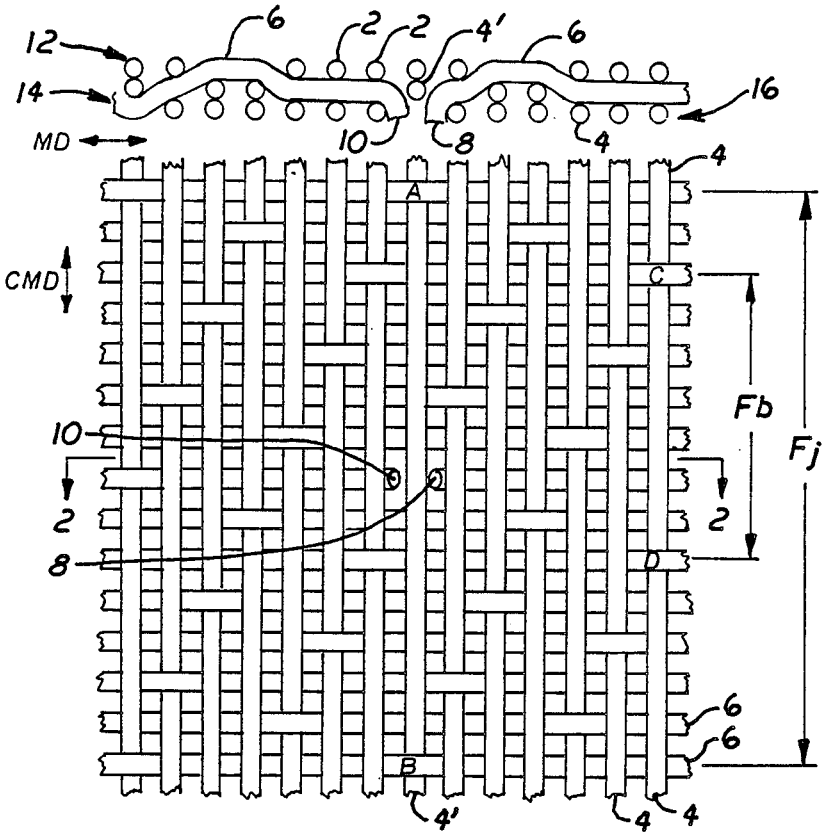
FIG. 2
PRIOR ART
FIG. 1
PRIOR ART
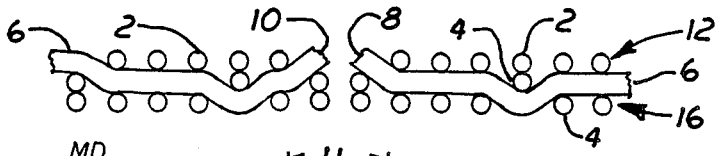
FIG. 4
PRIOR ART
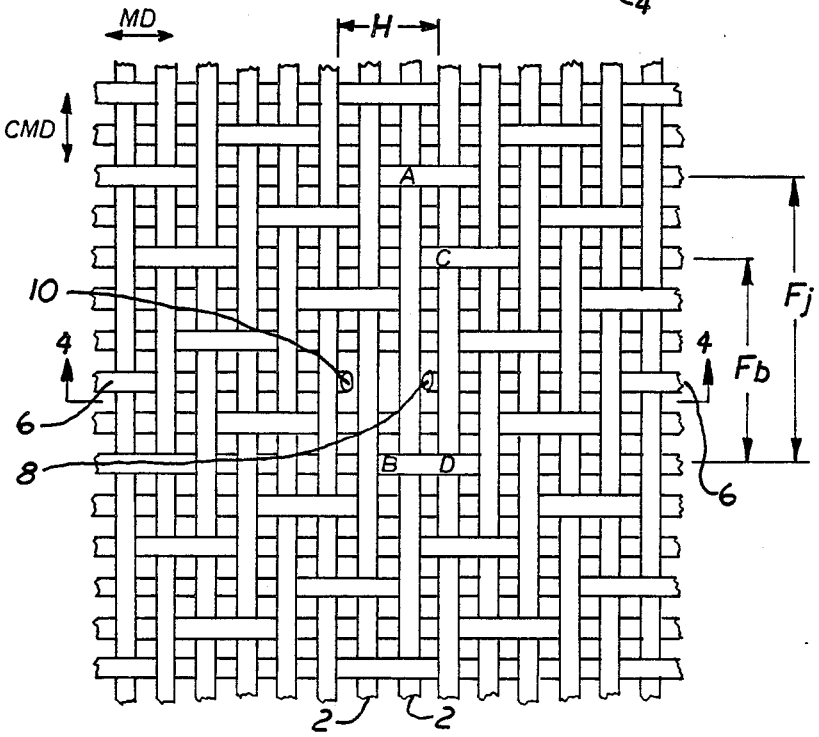
FIG. 3
PRIOR ART

SEAM FOR MULTILAYER PAPERMAKING FABRIC AND METHOD OF MAKING SAME

BACKGROUND OF THE INVENTION

This invention relates generally to multilayer papermaking fabrics. More particularly, this invention relates to techniques of forming a seam for joining the ends of a length of such flat woven fabric to form a continuous belt for use on a papermaking machine.

Early papermaking fabrics, whether used for forming or for drying were conventionally made of single layer weaves. More recently double, triple and other multilayer fabrics have become more popular because of their inherently superior qualities in wear, fluid permeability and the surface formed on resulting paper products. While such fabrics may be formed by an endless weaving technique in which the complete fabric belt is woven at one time, many of the more complex fabric weaves, and particularly those of multiple layers, are more conveniently woven flat, forming a strip of defined length whose ends are then joined by a suitable seaming technique to form an endless belt.

Traditional multilayer seaming techniques created the joins securing the opposed ends of each such machine direction filament at woven fabric knuckles, generally in the manner used traditionally in forming single layer fabric belts. In one known multilayer seaming technique the join securing the ends of each machine direction filament is formed on the sheet side of the belt. This is proven undesirable both in forming a large hole in the surface of the fabric and by the creation of pickets formed by the machine direction tails on the sheet side surface.

Prior art machine side joins have eliminated the pickets formed by the joined tails but have either created excessively long cross machine direction floats on the machine side surface or have created drainage path restrictions as a result of excess machine direction filament material in the join.

SUMMARY OF THE INVENTION

It is an object of the present invention to provide a technique for seaming multilayer woven fabrics that minimizes the differences between the body of the fabric and the join both in the strength of the fabric and in the drainage characteristics. It is a further object of the invention to provide such a seaming technique in which the sheet side surface of the fabric is substantially undisturbed by the join.

To achieve these and other objects, which will become apparent to those skilled in the art, there is provided a method of seaming to form a continuous belt from a length of flat woven multilayer papermaking fabric that has a sheet side surface defined as the upper surface thereof and a machine side surface defined as the lower surface thereof, such fabric being formed of a plurality of layers of cross machine direction filaments interwoven with a plurality of machine direction filaments in a predetermined pattern with each of the machine direction filaments crossing over selected filaments of the uppermost said layer of cross machine direction filaments, crossing under selected filaments of the lowermost said layer of cross machine direction filaments and passing intermediate said layers adjacent other selected said cross machine direction filaments. This method includes the steps of joining the opposed ends of the body of the fabric with a join formed adjacent the opposed ends of each such machine direction filament to secure the filament ends with each tail of each such machine direction filament end out of the fabric at a defined exit point on the machine side of such fabric, crossing each such machine direction filament under a cross machine direction filament in the lowermost layer thereof to form a machine side knuckle in said machine direction filament spaced from the closest such exit point by not less than one nor more than three intervening cross machine direction filaments and interweaving each such machine machine direction filament with the cross machine direction filaments such that the weave crossings in both the machine direction and the cross machine direction in the join are substantially the same as in the body of the fabric. By use of this method and the join formed thereby, differences in the strength and the drainage rate of the fabric in the join and in the body of the fabric may be minimized. In certain preferred embodiments of the method of this invention and the join formed thereby, each of the tails of the machine direction filament exit from the fabric on opposite sides of one such cross machine direction filament in the lowermost layer. In different embodiments the tails of each machine direction filament may exit between the same two adjacent such cross machine direction filaments in the lowermost layer.

BRIEF DESCRIPTION OF THE DRAWINGS

Several preferred embodiments of the filament join of this invention and the method of making it, and the differences between such joins and prior art joins are described in detail below in connection with the drawings in which:

FIG. 1 is a plan view of one prior art seaming technique for use on multilayer fabric to create a machine side join;

FIG. 2 is a sectional elevational view taken along line 2—2 of FIG. 1;

FIG. 3 is a plan view of a prior art seaming technique creating a sheet side join in a multilayer fabric;

FIG. 4 is an elevational sectional view taken along line 4—4 of FIG. 3;

DETAILS DESCRIPTION OF PREFERRED EMBODIMENT

Figure 6:
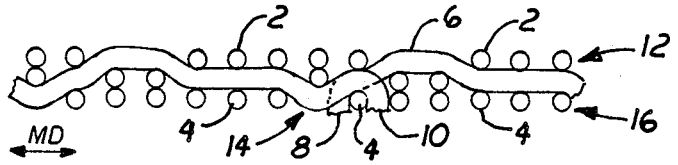
FIG. 6 PRIOR ART
FIG. 6 is an elevational sectional view taken along line 6—6 of FIG. 5.

The attached drawings illustrate, in FIGS. 1 through 6, several prior art seaming techniques utilized for multilayer fabrics, and, in FIGS. 7 through 12, three preferred embodiments of the improved seaming technique of the present invention. For each embodiment there is illustrated and described a single join of a single machine direction filament. It is to be understood that the opposing ends of each such machine direction filament are joined by substantially the same technique, with the joins of the various filaments spaced over an area of the weave typically several inches in length to provide for a smooth seaming arrangement rather than concentrating all joins along a single or very few cross machine direction filaments.

In FIGS. 1 and 2 are illustrated one form of prior art seaming technique applied to a multilayer papermaking fabric. This fabric is formed of a plurality of layers, in this case two, of cross machine direction filaments. In this embodiment the upper, or sheet side surface is formed of a layer of filaments 2 and the lower or machine side is formed of a layer of cross machine direction filaments 4. Interwoven with these cross machine direction (CMD) yarn are a plurality of machine direction (MD) yarns 6. In this embodiment the weave in the machine direction is a seven harness weave in the machine direction, although any convenient weave form may be utilized. As with each of the embodiments, the fabric is woven flat as a length of fabric with the ends to be joined by seaming to form the desired papermaking belt. The seam is formed by securing the opposing tails 8 and 10 defining the ends of each such machine direction filament 6 with each such filament tail passing out of the fabric at a defined exit point, as shown in the drawing. These tails 8 and 10 are secured by their engagement with the weave at these exit points, thus serving effectively to join those opposing ends of each such machine direction fabric. The passage of these tails 8 and 10 out of the fabric, thus securing the ends of each such machine direction filament 6 is defined as a "join."

As shown most clearly in FIG. 2, the join of the particular machine direction filament illustrated is formed on the machine side of the fabric, that is, with the tails 8 and 10 extending through the side of the fabric that engages the papermaking machine, as distinguished from the sheet side upon which the paper product is formed. This machine side join is desirable to eliminate the pickets caused by the joined tails 8 and 10 that could interrupt the otherwise smooth sheet side surface, were the tails to extend through that upper surface.

In this embodiment of FIGS. 1 and 2 the machine side join takes the place of the knuckle 14 that would otherwise be formed by the passage of the machine direction filament 6 under the particular cross machine direction 4' from the lowermost plane of the fabric. Although the seam or join formed by this technique achieves the desirable goal of eliminating sheet side pickets, it results in an undesirably long cross machine direction filament float $F_j$, extending between machine direction filaments A and B. This join float $F_j$ is actually twice the length of the machine side floats $F_b$ found in the body of the fabric. This long float is subject to premature fibrillation as a result of abrasion to the unrestrained cross machine float $F_j$ falling below the plane of the fabric. This long float is also subject to rapid degradation and weakening by high pressure showers in the papermaking process.

FIGS. 3 and 4 illustrate a typical dual layer fabric utilizing a prior art sheet side join technique. For the sake of simplicity and comparison, corresponding elements, such as the machine direction filaments and layers of cross machine direction filaments in this second embodiment, as well as all other embodiments in this application, incorporate the same reference numbers for corresponding elements. Thus, in this and all other embodiments the upper or sheet side layer of cross machine direction filaments 2 is denominated by the reference numeral 12 and the lowermost or machine side layer of those cross machine directions filaments is denominated by the reference numeral 16, with the individual such cross machine direction filaments in that layer indicated by reference numeral 4. It should be noted that FIG. 3 represents a top or sheet side plan view, as distinguished from the machine side plan view of FIGS. 1, 5, 7, 9 and 11.

While the join technique of this embodiment avoids the weakening effect of an excessively long machine side cross machine direction float in the join, it results in sheet side join floats $F_j$, between points A and B indicated on the fabric, that are still somewhat longer than the cross machine direction floats $F_b$ found elsewhere in the body of the fabric. More importantly, this join technique results in pickets on the sheet side of the fabric formed by the tails 8 and 10 that interfere with smooth forming of paper in the use of the fabric belt. Even more significantly, this join technique results in a hole (H) that extends completely through the fabric at each join and that permits unrestricted drainage at that point, resulting in a nonuniform rate of drainage through the fabric at that location. These holes may be made even larger through the action of the high pressure showers in the papermaking machinery upon the upwardly extending joined tail 8 and 10.

Figure 5:
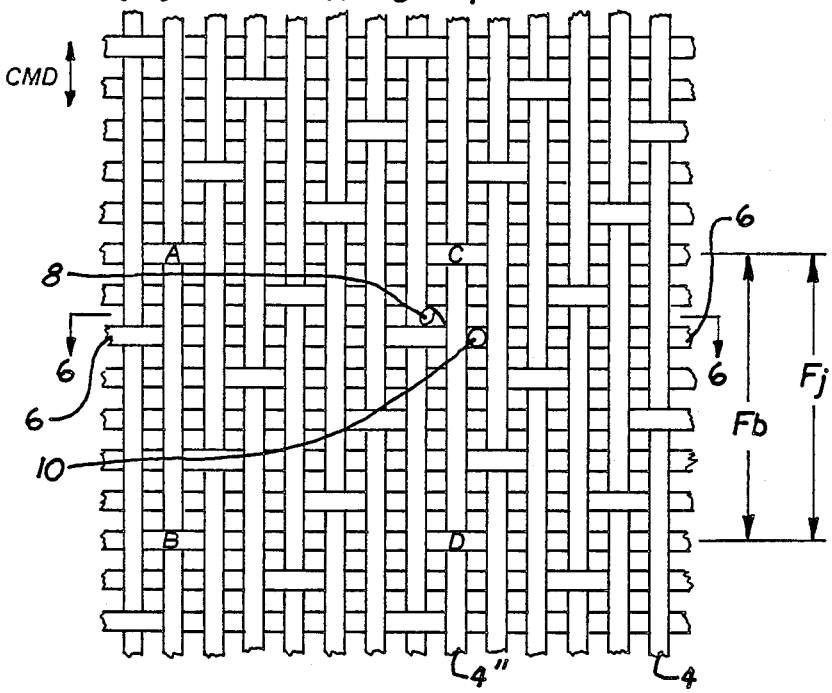
FIG. 5 PRIOR ART
FIG. 5 is another prior art seaming technique forming a machine side join in a multilayer fabric.

Yet another prior art join technique is illustrated in FIGS. 5 and 6. This technique, provides for both of the machine direction filament tails 8 and 10 crossing over a common cross machine direction filament 4'' in the lowermost or machine side layer 16 thereof immediately adjacent the exit points of those tails 8 and 10. By this join technique there is provided the desirable machine side join with the cross machine direction float $F_j$ in the machine side layer 16 in the join being the same as the floats $F_b$ elsewhere in the body of the weave. However, the lap required to provide the exit point for the tail 10 blocks an otherwise free opening in the weave, thus creating a drainage path restriction and resulting in a nonuniform rate of drainage in the join.

Figure 8:
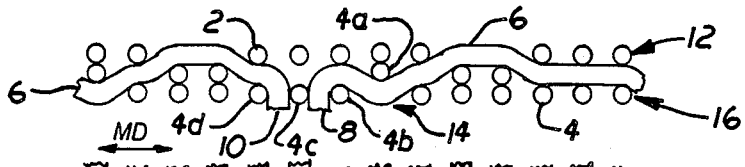
FIG. 8 is an elevational sectional view taken along line 8—8 of FIG. 7.
Figure 7:
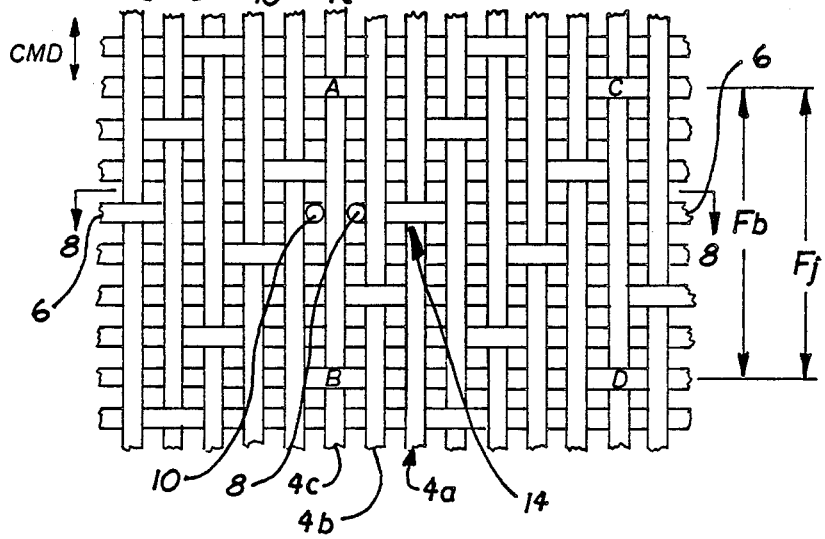
FIG. 7 illustrates one preferred embodiment of a seaming technique according to the present invention.

In FIGS. 7 and 8 are illustrated a first preferred embodiment of the improved seaming technique of this invention and the join resulting therefrom. While this join technique provides a machine side join having certain similarity to that of FIGS. 1 and 2, it should be noted that it creates a join site that is spaced from the machine side knuckle 14 instead of replacing such a knuckle as in the embodiment of FIGS. 1 and 2.

In this embodiment of FIGS. 7 and 8 each machine direction filament 6 crosses under a cross machine direction filament **4*a* in the lowermost layer thereof to form a machine side knuckle 14 in that machine direction filament 6. As shown in the illustrations, this knuckle 14 is, importantly, spaced from the closest exit point of the filament 6 by the intervening cross machine direction filament 4*b*. Thus, the tail 10 exits the fabric between the cross machine direction filaments 4*b* and 4*c*, as shown most clearly in the sectional elevational view of FIG. 8. The other tail 8 of this machine direction filament 6 exits the fabric between cross machine direction filaments 4and 4*d* in the lowermost layer of such cross machine direction filaments. In this manner both of the tails 8 and 10 of the machine direction filaments exit the fabric from an internal machine direction float, thus creating a join that is spaced away from the machine side knuckle 14, in contrast to the result obtained with the prior art embodiment of FIGS. 5 and 6. This improved join technique thus features the interweaving of each machine direction filament 6 with the cross machine direction filaments 4** in such a manner that the weave crossings or floats in both the machine direction and the cross machine direction in the join are substantially the same as in the body of the fabric. Thus, differences in the strength and drainage rate of the in the join, as compared with the strength and the drainage rates in the body of the fabric, may be minimized.

Of course, if the weave of the body of the fabric were other than the seven harness weave shown for purposes of this illustration, the machine side knuckle in the machine direction filament may conveniently be spaced from the closest such filament tail exit point by more than one intervening such cross machine direction filament 4, but preferably not more than three such intervening cross machine direction filaments.

Figure 10:
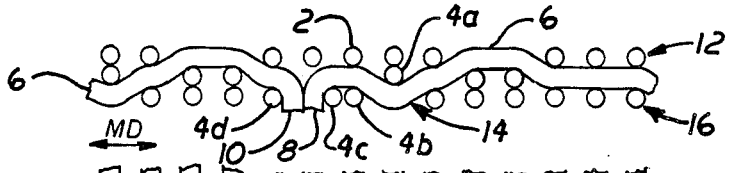
FIG. 10 is an elevational sectional view taken along line 10—10 of FIG. 9.
Figure 9:
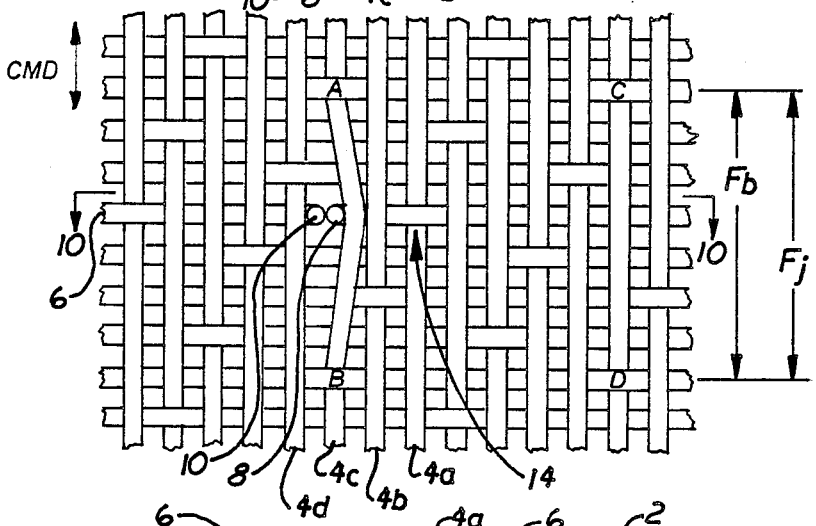
FIG. 9 is a second preferred embodiment of the seaming technique of the present invention.

Another desirable embodiment of the seaming technique of this invention is illustrated in FIGS. 9 and 10. This technique is generally similar to that of FIGS. 7 and 8, but with machine direction filament tail 10 passing over lowermost layer cross machine direction filament 4*c*. Thus, the tails 8 and 10 exit the fabric between the same two adjacent cross machine direction filaments 4*c* and 4*d* instead of on opposite sides of filament 4*c*, as provided in the embodiment of FIGS. 7 and 8. In this embodiment the machine side knuckle 14 is spaced from the filament tail exit points by two intervening such cross machine direction filaments 4*b* and 4*c* in that lowermost layer 16 of such filaments. In common with the embodiment of FIGS. 7 and 8, this embodiment of FIGS. 9 and 10 provides that each of the tails 8 and 10 of the machine direction filament 6 exits the fabric without crossing any cross machine direction filament crossed by the other such tail of that filament 6.

Figure 12:
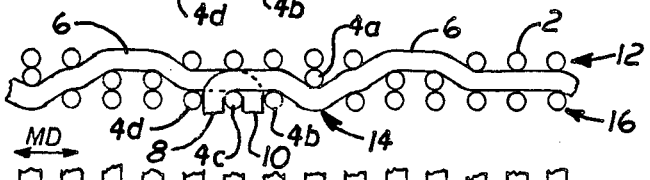
FIG. 12 is an elevational sectional view taken along line 12—12 of FIG. 11.
Figure 11:
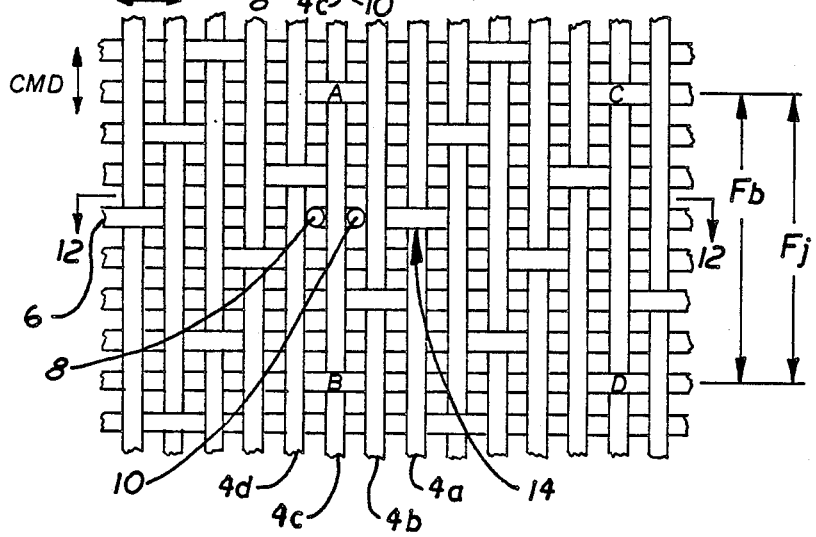
FIG. 11 is a third preferred embodiment of the seaming technique of the present invention.

Yet another embodiment of the seaming technique of this invention is illustrated in FIGS. 11 and 12. This embodiment bears some similarity to the prior art embodiment of FIGS. 5 and 6 in that both of the tails 8 and 10 of the machine direction filament 6 cross above a common cross machine direction filament 4*c* in the lowermost layer thereof with the exit points located immediately adjacent and on opposite sides of that common cross machine direction filament 4*c*. However, in contrast to the prior art structure of FIGS. 5 and 6, the machine side knuckle 14 is spaced from the nearest filament tail exit point, that being the exit point of tail 10, by one intervening cross machine direction filament 4*b* in the lowermost layer 16. In this embodiment of FIGS. 11 and 12 the machine side knuckle 14 is formed in the first portion of the machine direction filament 6 proximal the tail 8 with that knuckle 14 being spaced from the exit point of that tail 8 by two intervening such cross machine direction filaments 4*b* and 4*c* in that lowermost layer 16. Because the closest tail 10 is spaced from the knuckle 14 by the intervening filament 4*b*, the join formed by this improved technique avoids any substantial obstruction in the drainage path in the join, unlike that of FIGS. 5 and 6, and also provides for both machine direction and cross machine direction float in the join to be substantially the same as those in the body of the fabric to maintain substantial uniformity of strength and drainage rate in the join as well as throughout the body of the fabric.

While each of the embodiments illustrated describes and illustrates the join of a single machine direction filament, it is to be understood that such a join is applicable to each such machine direction filament and that, conveniently, the various joins of the machine direction filaments will be spaced over an area of the weave typically several inches in length to provide for a smooth seaming arrangement, rather than concentrating all joins along a single or very few cross machine direction filaments.

While the foregoing illustrates several preferred embodiments of the method of this invention of forming a seam in such a fabric and of the joins themselves that establish the seam, it is to be understood that the foregoing is illustrative only of the principles of the invention and is not to be considered limitative thereof. Accordingly, because this invention is applicable to numerous other weaves of multilayer fabric construction, especially those having five or more harnesses, and because numerous variations and modifications of this method and the resulting joins will readily occur to those skilled in the art, the scope of this invention is to be limited solely to the claims appended hereto.

What is claimed is:

1. In a flat woven papermaking fabric having a sheet side surface defined as the upper surface thereof and a machine side surface defined as the lower surface thereof, said fabric being formed of a plurality of layers of cross machine direction filaments interwoven with a plurality of machine direction filaments in a predetermined pattern with each of said machine direction filaments crossing over selected filaments of the uppermost said layer of cross machine direction filaments, crossing under selected filaments of the lowermost said layer of cross machine direction filaments and passing intermediate said layers adjacent other selected said cross machine direction filaments to form internal machine direction floats, a seam formed by joining the opposed ends of the body of said fabric with a join formed adjacent the opposed ends of each said machine direction filament to secure said filament ends with each tail of each said machine direction filament end passing out of said fabric at a defined exit point, said join comprising said exit point of each said machine direction filament tail being on said machine side of said fabric;

each said machine direction filament crossing under one filament in the lowermost layer of said cross machine direction filaments to form a machine side knuckle in said machine direction filament extending under only said one lowermost layer filament and spaced from the closest said exit point by not less than one nor more than three intervening cross machine direction filaments and each said end of said machine direction filament then exiting said fabric from one of said internal machine direction floats; and each said machine direction filament being interwoven with said cross machine direction filaments such that said weave crossings in both the machine direction and the cross machine direction in said join are substantially the same as in the body of said fabric, whereby differences in the strength and drainage rate of the fabric in the join and in the body of the fabric are minimized.

2. The fabric join of claim 1 wherein the respective exit points of each of said tails of said machine direction filament are on opposite sides of one said cross machine direction filament in said lowermost layer of said filaments.

3. The fabric join of claim 2 wherein each said tail of a given machine direction filament exits said fabric without crossing any cross machine direction filament crossed by the other said tail of that filament.

4. The fabric join of claim 3 wherein said machine side knuckle formed in said machine direction filament is spaced from the closest said filament exit point by one intervening said cross machine direction filament in said lowermost layer.

5. The fabric join of claim 2 wherein both said tails of said machine direction filament cross above a common cross machine direction filament with said exit points being located immediately adjacent said common cross machine direction filament.

6. The fabric join of claim 5 wherein said machine side knuckle is formed in a first portion of said machine direction filament proximal a first said tail with said exit point of said first tail being spaced from said knuckle by two intervening said cross machine direction filaments in said lowermost layer.

7. The fabric join of claim 1 wherein said exit points of both said filament tails are located between the same two adjacent said cross machine direction filaments in said lowermost layer.

8. The fabric join of claim 7 wherein said machine side knuckle formed in said machine direction filament is spaced from said filament exit points by two intervening said cross machine direction filaments in said lowermost layer.

9. A method of seaming to form a continuous belt from a length of flat woven multilayer papermaking fabric that has a sheet side surface defined as the upper surface thereof and a machine side surface defined as the lower surface thereof, said fabric being formed of a plurality of layers of cross machine direction filaments interwoven with a plurality of machine direction filaments in a predetermined pattern with each of said machine direction filaments crossing over selected filaments of the uppermost said layer of cross machine direction filaments, crossing under selected filaments of the lowermost said layer of cross machine direction filaments and passing intermediate said layers adjacent other selected said cross machine direction filaments to form internal machine direction floats, said method comprising the steps of joining the opposed ends of the body of said fabric with a join formed adjacent the opposed ends of each said machine direction filament to secure said filament ends with each tail of each said machine direction filament end passing out of said fabric at a defined exit point on said machine side of said fabric;

crossing each said machine direction filament under a single cross machine direction filament in the lowermost layer thereof to form a machine side knuckle in said machine direction filament extending under only said single lowermost layer filament and spaced from the closest said exit point by not less than one nor more than three intervening said cross machine direction filaments with each end of said machine direction filament then exiting said fabric from one of said internal machine direction floats; and interweaving each said machine direction filament with said cross machine direction filaments such that said weave crossings in both the machine direction and the cross machine direction in said join are substantially the same as in the body of said fabric, whereby differences in the strength and the drainage rate of the fabric in the join and in the body of the fabric may be minimized.

10. The method of claim 9 wherein each of said tails of said machine direction filament exit said fabric on opposite sides of one said cross machine direction filament in said lowermost layer thereof.

11. The method of claim 10 wherein each said tail of a given machine direction filament exits said fabric without crossing any cross machine direction filament crossed by the other said tail of that said filament.

12. The method of claim 11 wherein said machine side knuckle is formed in said machine direction filament at a location spaced from the closest said filament exit point by one intervening said cross machine direction filament in said lowermost layer.

13. The method of claim 10 wherein both said tails of said machine direction filament cross above a common cross machine direction filament in the lowermost layer thereof with said exit points being located immediately adjacent said common cross machine direction filament.

14. The method of claim 13 wherein said machine side knuckle is formed in a first portion of said machine direction filament proximal a first said tail with said knuckle being spaced from said exit point of said first tail by two intervening said cross machine direction filaments in the lowermost layer thereof.

15. The method of claim 9 wherein each of said tails of said machine direction filament exit said fabric between the same two adjacent said cross machine direction filaments in said lowermost layer.

16. The method of claim 15 wherein said machine side knuckle is formed in said machine direction filament at a location spaced from both said exit points by two intervening said cross machine direction filaments in said lowermost layer.

* * * * *